US007874464B2

(12) United States Patent
Prague et al.

(10) Patent No.: US 7,874,464 B2
(45) Date of Patent: Jan. 25, 2011

(54) VENTING SYSTEM FOR A PRODUCT DISPENSING DEVICE

(75) Inventors: David Prague, Ringoes, NJ (US); Patrice Barre, Antony (FR)

(73) Assignee: L'Oreal, Paris (FR)

( * ) Notice: Subject to any disclaimer, the term of this patent is extended or adjusted under 35 U.S.C. 154(b) by 687 days.

(21) Appl. No.: 11/516,625

(22) Filed: Sep. 7, 2006

(65) Prior Publication Data

US 2008/0061084 A1 Mar. 13, 2008

(51) Int. Cl.

| | |
|---|---|
| ***A45D 40/04*** | (2006.01) |
| ***A45D 40/16*** | (2006.01) |
| ***B05B 11/02*** | (2006.01) |
| ***B65D 83/76*** | (2006.01) |

(52) U.S. Cl. ..... 222/327; 222/387

(58) Field of Classification Search ..... 222/327, 222/386, 387

See application file for complete search history.

(56) References Cited

U.S. PATENT DOCUMENTS

| | | | | |
|---|---|---|---|---|
| 3,227,435 | A * | 1/1966 | Greer | 267/127 |
| 3,756,730 | A * | 9/1973 | Spatz | 222/390 |
| 4,298,036 | A | 11/1981 | Horvath | |
| 4,299,238 | A * | 11/1981 | Baidwan et al. | 600/576 |
| 4,632,672 | A * | 12/1986 | Kvitrud | 604/222 |
| 4,664,547 | A * | 5/1987 | Rosenwinkel | 401/175 |
| 4,690,154 | A * | 9/1987 | Woodford et al. | 600/578 |
| 4,700,448 | A | 10/1987 | Parker | |
| 4,792,065 | A * | 12/1988 | Soehnlein et al. | 222/387 |
| 5,000,355 | A | 3/1991 | Pritchard | |
| 5,131,773 | A | 7/1992 | Gueret | |
| 5,209,376 | A | 5/1993 | Dirksing | |
| 5,718,357 | A | 2/1998 | Dang | |
| 5,865,803 | A * | 2/1999 | Major | 604/122 |
| 6,793,431 | B1 * | 9/2004 | Tsai | 401/172 |
| 7,309,184 | B2 * | 12/2007 | Butcher et al. | 401/172 |

FOREIGN PATENT DOCUMENTS

| | | | |
|---|---|---|---|
| DE | 203 19 464 | U1 | 5/2004 |
| DE | 20 2005 000 531 | U1 | 9/2005 |
| EP | 192825 | A2 * | 9/1986 |
| EP | 0 431 304 | A2 | 6/1991 |
| WO | 98/10678 | | 3/1998 |

OTHER PUBLICATIONS

U.S. Appl. No. 11/516,624, filed Sep. 7, 2006, Prague.
U.S. Appl. No. 11/756,111, filed May 31, 2007, Prague.
English Translation of Chinese Office Action (200710149100.0) dated Sep. 8, 2010.

* cited by examiner

*Primary Examiner*—Kenneth Bomberg
(74) *Attorney, Agent, or Firm*—Oblon, Spivak, McClelland, Maier & Neustadt, L.L.P.

(57) ABSTRACT

A device for containing and dispensing a product includes a piston secured to a base portion and a housing configured to be secured to the base portion, the housing including an open first end for receiving the piston and a second end for dispensing the product. At least one aperture is formed on a portion of the piston to allow air compressed in the device to flow there through.

18 Claims, 2 Drawing Sheets

VENTING SYSTEM FOR A PRODUCT DISPENSING DEVICE

BACKGROUND

1. Field of the Invention

This invention relates to a device for dispensing a product, such as a cosmetic product, from a housing using a piston venting system to help control the flow of the product out of the housing and to eliminate pressurization of the package during filling.

2. Description of Related Art

The invention relates to a packaging and dispensing device, and particularly to a device that is suitable for the packaging of a product in a housing having an opening at one end for dispensing product. An operable end of the device is designed to be controlled by the user to regulate a dispensing of the product. The operable device can controllably move a product engaging structure to force product out of the device in an amount desired by the user.

However, air can become compressed between the product and other parts of the device when the device is filled during manufacturing. That is, in the related art, an air gap can be formed between an end of the product fill and the product engaging structure designed to propel the product out of the device. The air that becomes compressed could prevent proper assembly due to buildup of pressure.

Further, if the pressure from the compressed air is not allowed to be relieved prior to consumer use, the compressed air could prematurely force the product out of the device at an undesirable time. In addition, the presence of the compressed air could cause the product to dry out or otherwise reduce the performance characteristics of the product and thus, affect the quality of the product.

Accordingly, dispensing devices of the related art lack proper venting and therefore difficulty in producing the device is increased and/or an unacceptable loss of the product results when dispensing the product out of the device. Unintentional loss through the dispensing holes of the device and a changing of the characteristics of the product are wasteful and can also interfere with the ability of the device to dispense a desirable amount of product to the user.

SUMMARY OF THE INVENTION

The trapping of air when filling a product into a dispensing device is common. However, having the compressed air create pressure between the product and other areas of the device can be avoided.

In an example of the invention, the venting system includes at least one vent formed with a product engaging device to allow air to move in a direction substantially away from the product and out through the vent. By way of example, the product engaging device is a piston.

According to one or more examples of the invention, the air that passes through the vent is flowed to a vent chamber to be stored and/or discharged. By way of example, the chamber can be a channel or groove formed around a circumference of the piston. According to an example of the invention, the chamber is formed into a plurality of chambers and a plurality of vents is provided in fluid communication with a respective chamber of the plurality of chambers.

In an example of the invention, a forward seal and a rear seal are provided on a portion of the piston and are configured to form and airtight seal around an edge of the vent chamber in order to contain the air that passed through the vent into the chamber.

An example of the invention includes a piston with a flange portion formed at one end of the piston and having the at least one vent formed on the flange portion. According to an example, the forward and rear seal are provided on the flange and engage an interior surface of the housing containing the product and the vent is formed in an area between the seals.

In accordance with one or more embodiments of the invention, a first portion of the device filled with product is mated with a second portion of the device configured to control the rate of discharge of the product, and air that is trapped in between the first portion and second portion of the device is forced to flow through a gap formed by the flange and then through the at least one vent into the chamber. In an example, at least one of the at least one vent is formed substantially perpendicularly to a direction of movement of the piston.

The device according to the invention may advantageously be used for packaging and dispensing of a cosmetic or dermatological product, in the form of a liquid, soft, semi-soft, or hard product.

It is one of the objects of the invention to provide a product dispensing device configured to reduce, minimize, or prevent unintentional loss of the product.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF PREFERRED EMBODIMENTS

In the development and assembly of a product dispensing device, the formation of compressed air in the body of the device during filling of a product into the device and subsequent trapped head space air after filling have been identified as deterrents to proper filling and package performance. Accordingly, the piston venting system of examples of the invention is a device for evacuation of the trapped air that has formed between various components of the dispensing device.

Figure 1:
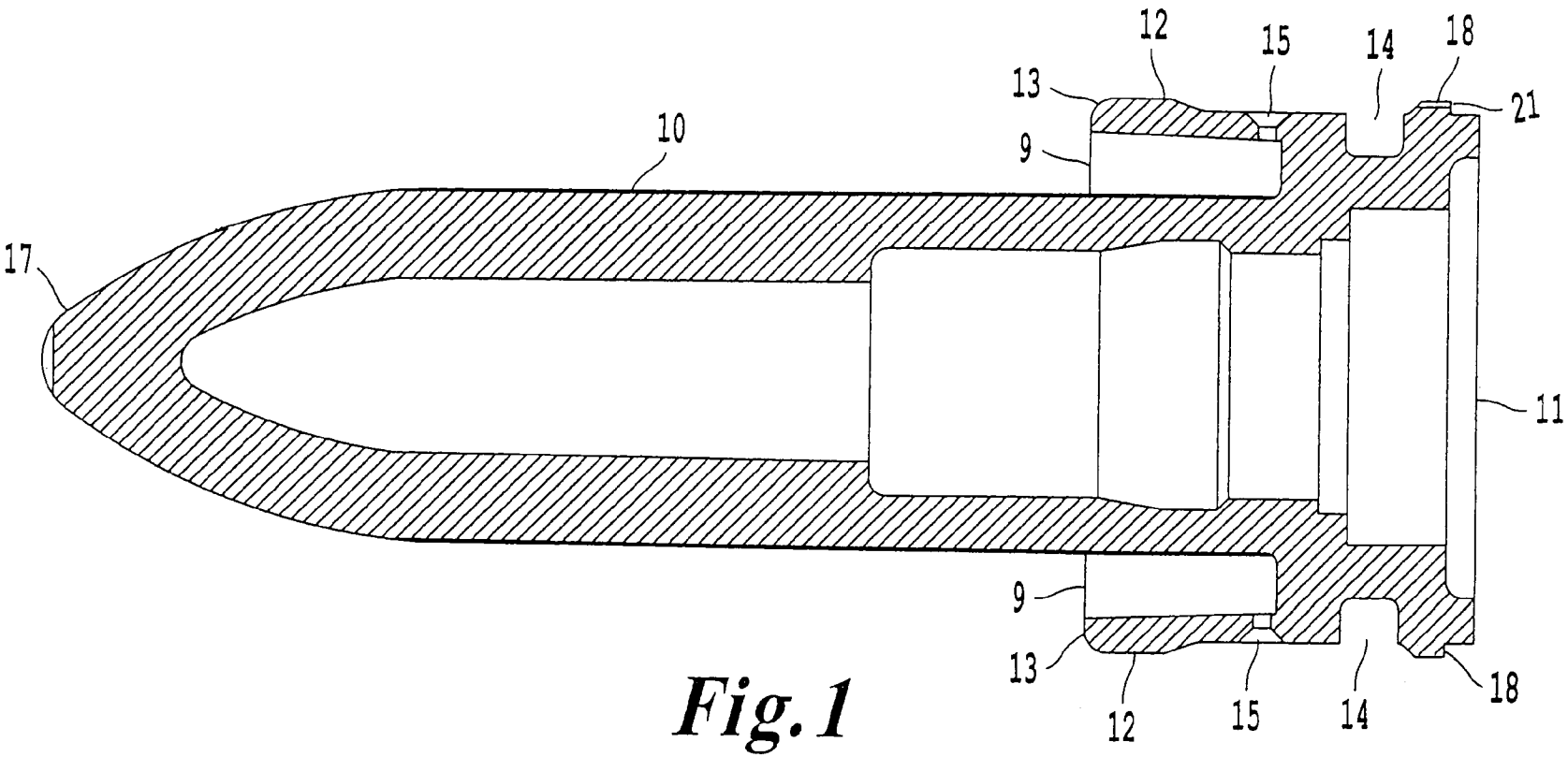
FIG. 1 is a schematic showing a piston according to examples of embodiments of the invention.

FIG. 1 is a schematic showing a piston 10 according to an example of the invention. The piston 10 can be formed having a generally cylindrical cross-sectional shape with a tip end 17 and an open end 11. The piston can have any desirable shape such as square and oval and can be formed from any material, such as plastic. The open end 11 of the piston 10 can lead to a hollow interior of the piston 10 that is configured to receive, for example a driving device 25 described with respect to FIGS. 2 and 3. It should be appreciated that the hollow interior of the piston 10 can extend along any length of the piston 10. The interior of the piston 10 can be any shape and can have any desirable cross section designed to receive the driving device 25. Alternatively, the piston 10 could be formed without a hollow interior and be configured to engage the driving device 25 at an exterior surface thereof.

When air is forced in and around gap 9, venting of the compressed air is achieved by creating a vent hole or aperture 15 or a series of vent holes in the piston 10. It should be appreciated that the vent holes can be placed in any portion of the piston. For example, the vent 15 can be formed along an outer edge of the piston 10. As shown in FIG. 1, the vent 15 can be formed along a flange 13 of the piston 10. The flange 13 can be formed at a distance away from an outer edge of the piston 10 forming the gap 9 there between. The size of the gap 9 can be any size depending on the overall dimensions of the remaining features of the device according to examples of the invention. The flange 13 can extend around a portion of or completely around the body of the piston 10. By way of example, a plurality of vents 15 can be formed along the flange13 and can be any shape or size such as for example, an oval, conical, and/or square. Further, the vents 15 can be located anywhere along the length of the flange 13 as so desired. Additionally, the one or more vents 15 can be formed through the flange 13 substantially perpendicular to the movement of the piston 10 and/or flow of the product 20. However, it should be appreciated that the one or more vents 15 can be formed at any angle through the flange 13 depending on functional and/or manufacturing considerations. Accordingly, when air is forced in and around the gap 9, at least a portion of the air can escape from the gap 9 through the at least one vent 15.

The one or more vents 15 can lead to a secondary vent chamber 14. The secondary chamber 14 is formed in part by a forward piston seal 12 and a rear piston seal 18, and a contour of the outer surface of the piston 10. As such, air in the gap 9 is in fluid communication with the vent chamber 14 through the at least one vent 15. The vent chamber 14 can be in the shape of a channel like structure that is formed around the periphery of the piston 10. Alternatively, according to examples of the invention, the vent chamber 14 can be formed only around a portion of the periphery of the piston 10 and/or can be divided up and form multiple chamber sections. Further, the one or more chambers 14 are formed to be in fluid communication with one or more of the at least one vent 15. Therefore, multiple chambers 14 can be formed depending on the number of vents 15 created. The fluid communication between the gap 9, vent 15 and vent chamber 14 provides for the release of for example, the compressed air formed in the air gap 9. Accordingly, a reduction or prevention of a pressure build-up during filling of the device with a user product and/or at any other time during or after assembly of the device can be addressed or achieved.

Figure 2:
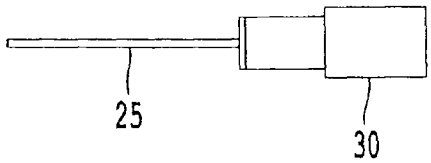
FIG. 2 is a schematic showing a driving member of examples of the invention.

FIG. 2 is a schematic showing an end portion 30 for a device according to an example of the invention. The end portion 30 can be secured to the structure of base portion 6 or can be formed integrally there with. The end portion 30 can provide an end support for the base portion 6 and have a generally flat bottom surface to allow the device to be stored vertically if desired. A driving device or extending portion 25 can be a threaded rod or similar type structure that has one end secured to or embedded in the end portion 30 and the other end configured to engage the piston 10. The end configured to engage the piston 10 can be a flat surface or formed with one or more protrusions or grooves. As such, it should be appreciated that the piston engaging end can have any desirable shape and/or configuration. The driving device 25 may be generally parallel to the housing of the base portion 6 or can be formed at an angle if so desired. The driving device 25 is configured to receive the threads of the end portion 30 and move upwardly and downwardly depending on the rotation of the end portion, acting as an operable member, 30 controlled by the user. Due to the connection between the driving device 25 and the piston 10, as the driving device 25 is moved upwardly or downwardly a corresponding movement of the piston 10 is generated. Accordingly, the movement of the product stored in the device is controlled by the movement of the piston 10.

Figure 3:
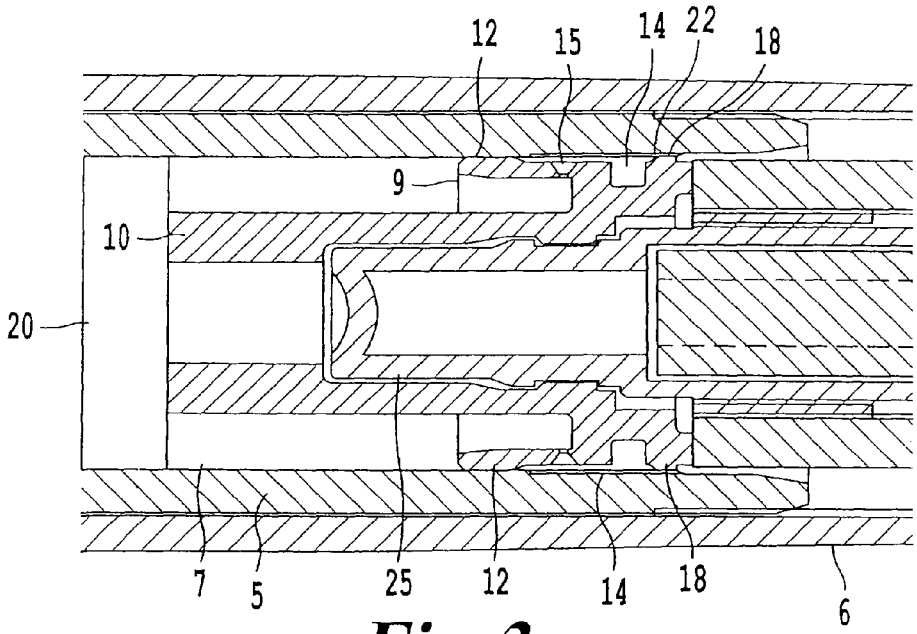
FIG. 3 is a schematic showing the assembled piston venting system according to examples of embodiments of the invention.
Figure 4:
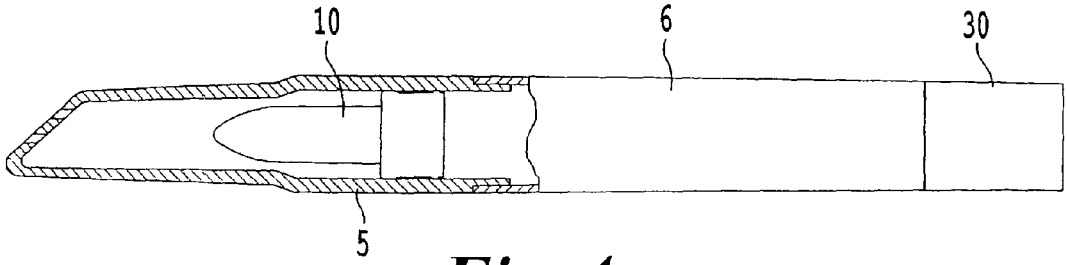
FIG. 4 is a schematic showing a product dispensing device according to one or more examples of the invention.

FIGS. 3 and 4 are schematics showing a cross-sectional view of a portion of a product dispensing device created by the engagement of the housing 5 and the base assembly portion 6. After the housing 5 is filled with the consumer product 20, the base assembly 6 that includes the piston 10 and end portion 30 can be engaged with the housing 5. The open portion of the housing 5 at one end thereof, allows for insertion of the piston 10 into the housing 5. As shown in FIG. 3, one end of the driving device 25 is engaged with at least a portion of the piston 10. It should be appreciated that the driving device 25 can engage an interior portion of the piston 10 if the piston has a hollow portion, or can engage an outer end surface of the piston 10. Further, the driving device 25 can include a notch or protrusion or similar type structure to engage with a notch or protrusion or similar type structure of the piston 10 to provide for a secure connection with the piston 10 or portion thereof. Accordingly, one or more embodiments of the invention provide for a rotation of the end portion 30 which translates the move to the driving device 25 and correspondingly moves the piston 10 in a desired manner. Thus, the operable device end portion 30 can be located at or near an end of the device in order to drive the product from the opposite end of the device through at least one discharge hole 27 shown in FIG. 4 and be applied to the user.

The product dispensing device of an example of the invention can be tubular having a length with a greater dimension than a width. It should be appreciated that the device can be any size and configuration and can have a round, oval, square, rectangular, or any other desirable shape. Within a body of the housing 5, a reservoir or hollow area is provided that contains the product 20 to be discharged from the device. The housing 5 has side walls and one end forming a tip for dispensing the product and another end having an open portion. Therefore, the consumer product 20, such as lipstick, lip gloss, cream, or any other type of cosmetic product, can be filled into at least a portion of the reservoir area of the housing 5 to be stored and contained therein. It should further be appreciated that the product 20 can be a soft, semi-soft, hard, liquid, or other flowable product and can also be a gel, cream, or powder. An end piece, such as a cap or cap-like device can be placed over the tip dispensing end of the housing 5 before, during or after the product is filled into the housing in order to help contain the product in the housing.

As discussed above, the product dispensing device of one or more examples of the invention is created by connecting the housing 5 and the housing of the base assembly portion 6. As the housing 5 and base portion 6 are secured together, the forward piston seal 12 will engage an interior surface of the housing 5 reducing or preventing air from escaping between the forward piston seal 12 and housing 5. Similarly, the rear piston seal 18 will slidably engage an interior surface of the housing 5 forming a seal there between. As such, creating a seal between the housing 5 and the one or more seals will force the compressed air formed from the engaging of the housing 5 and base assembly 6, to flow into the air gap 9 and out through the at least one vent 15 into the vent chamber 14. According to an example of the invention, vents can be formed in the housing 5 and/or base portion 6 to allow the air in the vent chamber 14 to escape therein.

Accordingly, the secondary chamber 14 is formed in part by the forward piston seal 12 and the rear piston seal 18. As best shown in FIG. 3, the forward seal 12 and rear seal 18 have a first diameter that will allow the seals to engage the interior surface of the housing 5. By way of example, the chamber 14 can be formed from a contour of the piston 10 in an area of the piston between the forward 12 and rear 18 seals. The contour of the chamber can be any desirable shape having a diameter smaller than a diameter of the forward 12 and rear 18 seals. That is, the outer surface of the contour should not engage the interior surface of the housing 5 in order to allow an open area into which the air can flow when forced through the vent 15.

According to an example of the invention, both the forward piston seal 12 and rear piston seal 18 are continuously engaged with the interior wall of the housing 5 after the housing 5 and base assembly portion 6 are engaged. Alternatively, the forward seal 12 can continuously form an airtight seal while the rear seal 18 slides for a set distance in the housing 5 before contacting housing vents 22 shown in FIG. 3, that allow the air contained in the vent chamber 14 to be released through the housing vents 22. As such, as the piston is slid forward in the housing 5, air is able to flow through the at least one vent hole 15 and into the at least one vent chamber 14. Accordingly, the vented piston of examples of the invention allows for assembly of the device containing the product with little or no pressurization. Thus, elimination of head space air during initial articulation of the package is addressed and/or achieved. Finally, the vented piston reduces or eliminates the creation of latent product release due to the reduction of residual pressurization.

The rear piston seal 18 may also have a single or series of slits 21, shown in FIG. 1., cut into its surface. These slits 21 will act as a vent path for the compressed air when no housing vents are available. The flexibility of the rear piston seal 18 will allow the area around the slits 21 to form back together or heal after the filling and manufacturing process is complete and pressure in the pack has decreased or been normalized. This healing process creates an airtight piston seal that allows this piston to be used with formulas containing volatiles and other elements where loss of these elements through a permanently opened vent would affect product performance and efficacy.

While exemplary embodiments of the invention have been described in conjunction with the embodiments outlined above, it is evident that many alternatives, modifications and variations will be apparent to those skilled in the art. Accordingly, exemplary embodiments of the invention, as set forth above, are intended to be illustrative, not limiting. Various changes may be made without departing from the sphere and scope of the invention.

What is claimed as new and desired to be secured by letters patent of the United States is:

1. A device for containing and dispensing a product, comprising:

a base portion;

a piston secured to the base portion;

a first and second protrusion formed around a circumference of the piston;

a housing configured to be secured to the base portion, the housing including a first end configured to receive the piston and a second end having at least one discharge hole to dispense the product; and at least one aperture formed on a portion of the piston, wherein when the base portion and housing are secured together, an airtight seal is created between the first and second protrusion and an inside surface of the housing, and wherein air is able to flow through the at least one aperture into a chamber, the chamber being formed by the first and second protrusion, the inside surface of the housing, and a portion of an outer surface of the piston, wherein the first and second protrusions have a first diameter, and the portion of the outer surface of the piston in an area of the chamber has a second diameter smaller than the first diameter, wherein the at least one aperture is formed in between the first and second protrusions in the portion of the outer surface of the piston having the second diameter, wherein the piston includes a flange formed around the circumference of the piston and spaced apart from a main body of the piston to form a gap between the main body and the flange, the gap having a first end located towards a dispensing side of the device and a second end located at an end opposite the first end, wherein the aperture is located at the second end such that when air is forced into the gap due to the seal formed by the first protrusion the air flows in a direction substantially away from a dispensing movement direction of the piston and through the aperture into the chamber, and wherein the second protrusion includes a plurality of slits formed thereon, such that side surfaces of the plurality of slits are spaced apart when pressure within the device is increased, and the side surfaces of the plurality of slits are configured to contact each other when pressure within the device has decreased.

2. The device according to claim 1, wherein a longitudinal axis of at least one of the at least one aperture is formed substantially perpendicular to a direction of movement of the piston.

3. The device according to claim 1, wherein said product is a cosmetic product.

4. The device according to claim 1, wherein the product is a lipstick product.

5. The device according to claim 1, wherein the piston has a hollow interior and the second end of the piston forms an opening to the interior of the piston.

6. The device according to claim 5, further comprising:

an operable member secured to the base portion, the operable member includes an extending portion configured to engage and control movement of the piston.

7. The device according to claim 6, wherein the extending portion engages the interior of the piston.

8. The device according to claim 7 wherein the operable member is controlled by the user.

9. The device according to claim 1, wherein the at least one aperture extends through the flange and a first end of the aperture is in fluid communication with the gap and another end of the aperture is in fluid communication with the chamber.

10. The device according to claim 9, wherein the first protrusion is formed near an outside edge of the flange and creates an airtight seal with the inside surface of the housing, and wherein the second protrusion is formed near the second end of the piston and forms an airtight seal with the inside surface of the housing.

11. The device according to claim 1, wherein the portion of the outer surface of the piston in an area of the chamber has a first region with a first diameter and a second region with a second diameter smaller than the first diameter, wherein the diameters of both the first and second regions are smaller than the diameters of the first and second protrusions.

12. The device according to claim 11, wherein the at least one aperture extends between the gap and the first region having the first diameter.

13. A device for containing and dispensing a product, comprising:

a first portion configured to control a dispensing rate of the product from the device;

a second portion securably attached to the first portion and including housing walls to contain the product;

a piston secured to the first portion, the piston including a flange formed around a circumference of the piston and spaced apart from a main body of the piston to form a gap between the main body and the flange, the gap having a first end located towards a dispensing side of the device and a second end located at an end opposite the first end; and at least one air escape vent associated with the flange, wherein the flange includes a first part and a second part, the first part provided on either side of the second part to form a seal with respect to the housing walls and having a first diameter, and the second part having a diameter smaller than the first diameter to form an air escape chamber, and wherein the at least one air escape vent extends through the flange from the gap to the second part and is located at the second end of the gap such that when air is forced into the gap due to the seal formed by the first part the air flows in a direction substantially away from a dispensing movement direction of the piston and through the air escape vent into the air escape chamber, and wherein the housing includes a first region of an inner surface of the housing that has a first diameter, and a second region formed along a portion of the inner surface of the housing that has a second diameter larger than the first diameter, such that the second region forms housing vents that allow the air contained in the air escape chamber to be released.

14. A device according to claim 13, wherein a longitudinal axis of at least one of the at least one air vents extends substantially perpendicular to a direction of movement of product out of the second portion.

15. A device according to claim 13, wherein the flange forms a cup circling a portion of an elongated projection of the piston.

16. A device according to claim 15, wherein the first part of the flange includes a first seal formed on a forward end of the flange and a second seal formed on a rear portion of the flange spaced apart from each other and configured to engage the housing walls.

17. A device according to claim 16, wherein the forward seal, rear seal, housing walls, and second part of the flange form the air escape chamber there between, and wherein air flowing through the at least one air escape vent flows into the chamber.

18. The device according to claim 13, wherein the second part of the flange in an area of the chamber has a first region with a first diameter and a second region with a second diameter smaller than the first diameter, wherein the diameters of both the first and second regions are smaller than the diameters of the first parts provided on either side of the second part.

* * * * *